US010475423B1

(12) United States Patent
Hirasawa

(10) Patent No.: US 10,475,423 B1
(45) Date of Patent: Nov. 12, 2019

(54) PEDAL DEVICE FOR MUSICAL INSTRUMENT

(71) Applicant: HOSHINO GAKKI CO., LTD., Nagoya, Aichi (JP)

(72) Inventor: Satoshi Hirasawa, Nagoya (JP)

(73) Assignee: HOSHINO GAKKI CO., LTD., Nagoya (JP)

( * ) Notice: Subject to any disclaimer, the term of this patent is extended or adjusted under 35 U.S.C. 154(b) by 0 days.

(21) Appl. No.: 16/285,214

(22) Filed: Feb. 26, 2019

(30) Foreign Application Priority Data

Sep. 13, 2018 (JP) ..... 2018-171205

(51) Int. Cl.
*G10D 13/00* (2006.01)

(52) U.S. Cl.
CPC ..... *G10D 13/006* (2013.01)

(58) Field of Classification Search
CPC ..... G10D 13/006
See application file for complete search history.

(56) References Cited

U.S. PATENT DOCUMENTS

| | | | | |
|---|---|---|---|---|
| 5,883,321 | A | 3/1999 | Hsieh | |
| 9,640,154 | B2 | 3/2017 | Sikra | |
| 9,928,815 | B2 | 3/2018 | Sikra | |
| 2002/0152872 | A1* | 10/2002 | O'Donnell | G10D 13/006 84/422.1 |
| 2011/0146475 | A1* | 6/2011 | Luo | G10D 13/006 84/422.1 |

FOREIGN PATENT DOCUMENTS

| | | | |
|---|---|---|---|
| JP | 2572422 | Y2 | 1/1994 |
| JP | 6-73794 | U | 10/1994 |
| JP | 2003-150151 | A | 5/2003 |

* cited by examiner

*Primary Examiner* — Kimberly R Lockett

(57) ABSTRACT

A pedal angle adjusting device is coupled to a coupling arm such as to be pivotable about an axis. Also, the pedal angle adjusting device is coupled to a free end of a pedal such as to be pivotable about an axis and arranged to be fixable to the free end of the pedal.

8 Claims, 10 Drawing Sheets

PEDAL DEVICE FOR MUSICAL INSTRUMENT

CROSS-REFERENCE TO RELATED APPLICATIONS

This application is based upon and claims the benefit of priority from prior Japanese Patent Application No. 2018-171205, filed on Sep. 13, 2018, the entire contents of which are incorporated therein by reference.

BACKGROUND OF THE INVENTION

The present invention relates to a pedal device for musical instrument to be used with a bass drum or a high hat stand.

Japanese Published Unexamined Utility Model Application No. H6-73794 and Japanese Registered Utility Model No. 2572422 each discloses a pedal device for drum, arranged such that an inclination angle of a pedal and an initial angle of a beater are separately adjustable. With each of the pedal devices disclosed in the two documents, a free end of the pedal is coupled to a sprocket wheel via a chain and the chain is fixed in a state of being wound around an outer circumferential portion of the sprocket wheel. The sprocket wheel is fixed to a rotating shaft together with a rocker cam, coupled to a tension coil spring, a circular columnar body, to which a beater fixing member is fixed, etc. Also, the beater is pivotably mounted to an outer circumferential surface of the circular columnar body by a fastening bolt provided on the beater fixing member.

To adjust the inclination angle of the pedal, first, a bolt provided on the rocker cam is loosened. Next, the chain is drawn out from the sprocket wheel or the chain is wound up while pivoting the rotating shaft with respect to the rocker cam until the free end of the pedal is set at a desired height. The bolt is then fastened to fix the rotating shaft to the rocker cam and fix the inclination angle of the pedal. On the other hand, to adjust the initial angle of the beater, first, the fastening bolt of the beater fixing member is loosened. Next, while maintaining the free end of the pedal at the adjusted height, the beater fixing member is slid in a circumferential direction along the outer circumferential surface of the circular columnar body until the beater is set at a desired angle. The fastening bolt is then fastened to fix the beater fixing member to the circular columnar body and fix the initial angle of the beater. However, with the pedal device for drum disclosed in both documents, it is not possible to adjust just the inclination angle of the pedal.

Japanese Laid-Open Patent Publication No. 2003-150151 discloses a high hat stand arranged such that an inclination angle of a pedal is adjustable. With the high hat stand disclosed in this document, a free end of a pedal is coupled via a chain to a rod that actuates a cymbal. The rod is inserted through an inner side of a spring that is vertically disposed at an inner side of a lower pipe. Also, a protrusion, projecting radially outward, is provided at an intermediate portion of the rod. By being compressed from above by the protrusion of the rod, the spring imparts a repulsive force that is generated when the pedal is stepped on. Also, the rod is inserted through a cylindrical female thread body fixed to a gate frame and a cylindrical male thread body thread-engaged with the female thread body from below. A head portion of the male thread body is contacted from below with a shock absorber, provided at an upper end of the chain. Thereby, an upper limit position of the shock absorber can be restricted by the male thread body and the inclination angle of the pedal can be adjusted in accordance with a thread engagement amount of the male thread body with respect to the female thread body. However, when the upper limit position of the shock absorber is changed, a height of the rod is also changed and an amount of compression of the spring by the rod thus also changes. The repulsive force of the pedal thus also changes and an operation feel when the pedal is stepped on also changes. It is therefore not possible to adjust just the inclination angle of the pedal with the high hat stand disclosed in this document as well.

For example, U.S. Pat. Nos. 9,928,815, 9,640,154, and 5,883,321 each discloses a pedal device, with which just an inclination angle of a pedal is adjustable. With each of the pedal devices disclosed in these documents, when the inclination angle of the pedal is to be adjusted, first, a free end of the pedal is slid vertically with respect to a link member or a chain to change a height of the free end of the pedal. Next, while maintaining the free end of the pedal at the adjusted height, the free end of the pedal is fixed to the link member or the chain by a bolt. At this point, a user slides the free end of the pedal with one hand to adjust the inclination angle of the pedal and thereafter fastens the bolt with the other hand while still holding the pedal with the one hand. Thus, conventionally, the above work is performed using both hands and therefore the adjustment of the inclination angle of the pedal is troublesome.

Especially in the case of each of U.S. Pat. Nos. 9,928,815 and 9,640,154, the bolt is inserted from a lateral direction with respect to the free end of the pedal and the link member in a state where the pedal device is mounted to a bass drum or a high hat stand. The user must thus adjust the inclination angle of the pedal while operating the bolt, which is at a position that is not easily visible. In the case of U.S. Pat. No. 5,883,321, a pedal angle adjusting mechanism is arranged from a pair of mutually engaging block bodies. A fixing force of fixing the free end of the pedal to the chain is thus higher than in the cases of U.S. Pat. Nos. 9,928,815 and 9,640,154. However, a fixing position of the pedal with respect to the chain, that is, a height position of the free end of the pedal can only be adjusted in stages. Fine adjustment of the inclination angle of the pedal thus cannot be performed.

Also, each of the pedal devices disclosed in U.S. Pat. Nos. 9,928,815, 9,640,154, and 5,883,321 has a protruding portion, extending perpendicularly from the free end of the pedal, because the pedal is slid vertically with respect to the link member or the chain. There are thus times where, in the middle of performing by operating the pedal, the protruding portion of the pedal contacts a toe of the performer or a part of the pedal device. There are also times where a stepping operation of the pedal is thereby obstructed.

SUMMARY OF THE INVENTION

It is an object of the present invention to provide a pedal device for musical instrument that allows just an inclination angle of a pedal to be adjusted easily.

In order to solve the foregoing problem, a pedal device for musical instrument is provided according to a first aspect of the present invention. The pedal device for musical instrument includes a base, having a front end and a rear end, a pedal, pulled upward at the front end of the base, pivotably coupled to the rear end of the base, and being pivoted about the rear end of the base as a center by a stepping operation, an actuating member, actuated by the stepping operation of the pedal, a coupling member, coupling the actuating member and a free end of the pedal and transmitting an operating force of the pedal to the actuating member, and a pedal angle adjusting device, coupling the coupling member and the free end of the pedal and adjusting an inclination angle of the pedal. The pedal angle adjusting device is arranged to be pivotable about axes respectively with respect to the coupling member and the free end of the pedal and be fixable with respect to one of either of the coupling member and the free end of the pedal.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

An embodiment of a pedal device 10, with which a pedal device for musical instrument according to the present invention is applied to a bass drum BD, shall now be described with reference to FIG. 1 to FIG. 5B.

Figure 1:
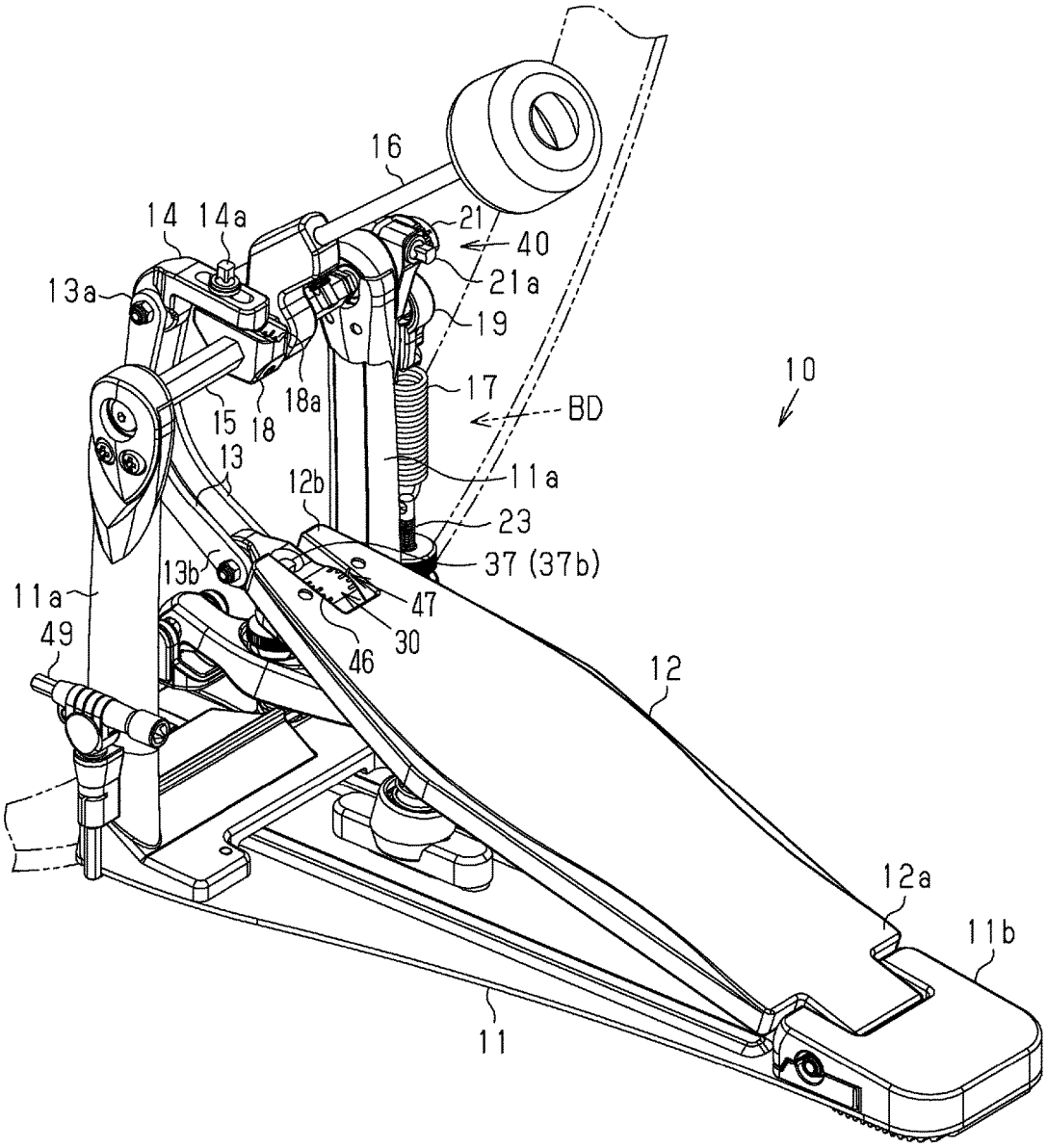
FIG. 1 is a perspective view of a pedal device according to an embodiment of the present invention.

As shown in FIG. 1, the pedal device 10 includes a base 11, a pedal 12, a pair of metal coupling arms 13 as a coupling member, a wheel 14, a shaft 15 as an actuating member, a beater 16, and a tension coil spring 17. The pedal device 10 adopts a direct drive system that directly transmits a stepping force of the pedal 12 to the shaft 15 by the coupling arms 13. The pedal device 10 is used in a state where a striking surface of the beater 16 is disposed to face the bass drum BD and the base 11 is coupled to the bass drum BD. In describing the arrangement of the pedal device 10 below, the side coupled to the bass drum BD (left side shown in FIG. 1) shall be stated as being the front and the opposite side with respect to the bass drum BD (right side shown in FIG. 1) shall be stated as being the rear.

The base 11 is formed to a plate shape extending in a front-rear direction. A heel portion lib, on which the heel of a foot of a performer is placed, is mounted to a rear end of the base 11. The pedal 12 has a base end 12*a*, coupled to the heel portion 11*b*, and a free end 12*b*, pulled upward at a front end of the base 11. The base end 12*a* of the pedal 12 is pivotably coupled to a front end of the heel portion 11*b*. The pedal 12 is supported such as to be inclined at an easily operable angle when not being stepped on and to be pivoted about the rear end of the base 11 as a center by a stepping operation.

A pair of support columns 11*a*, extending upward from both side portions, are provided at the front end of the base 11. The shaft 15 is pivotably supported by upper end portions of the pair of support columns 11*a*. Also, the wheel 14 and the coupling arms 13 couple the shaft 15 and the free end 12*b* of the pedal 12. The wheel 14 is mounted by a bolt 14*a* to a block body 18, fixed to the shaft 15. When the bolt 14*a* is loosened, the wheel 14 is made movable in the front-rear direction along a V-groove 18*a* formed in an upper surface of the block body 18.

Each coupling arm 13 has an upper end 13*a*, pivotably coupled to a front end of the wheel 14, and a lower end 13*b*, pivotably coupled to the free end 12*b* of the pedal 12. The coupling arm 13 is formed to a rounded, substantially L-like shape such as to curvingly couple the front end of the wheel 14 and the free end 12*b* of the pedal 12. The coupling arm 13 is disposed so as to overlap with the other coupling arm 13 across a fixed distance.

The tension coil spring 17 is provided at an outer side of the right-side support column 11*a*. An upper end of the tension coil spring 17 is coupled via a coupling ring 19 to a cam 21, fixed to an end portion of the shaft 15. A lower end of the tension coil spring 17 is coupled to an upper end of an adjusting screw 23, provided at a lower portion of the right-side support column 11*a*. In this state, the tension coil spring 17 is tensioned in a vertical direction and urges the cam 21 downward. The tension coil spring 17 is coupled, via the coupling ring 19, the cam 21, the shaft 15, the wheel 14, and the coupling arms 13, to the free end 12*b* of the pedal 12. By urging the cam 21 vertically downward, the tension coil spring 17 holds the pedal 12 at an initial position before the pedal 12 is stepped on.

When the pedal 12 is stepped on, the shaft 15 and the cam 21 are pivoted by the coupling arms 13 and the wheel 14 and the tension coil spring 17 is pulled obliquely upward by the pivoting of the cam 21. At this point, a force that returns the orientation of the cam 21 vertically downward acts on the cam 21 due to an elastic force of the tension coil spring 17. Therefore, if the stepping of the pedal 12 is released, the pedal 12 returns immediately from the stepped position to the initial position by the elastic force of the tension coil spring 17. By turning the adjusting screw 23 to adjust the tension amount of the tension coil spring 17, an operation feel when the pedal 12 is stepped on and a return speed of the beater 16 when the stepping is released are adjusted.

The pedal device 10 includes a pedal angle adjusting device 30, adjusting an inclination angle of the pedal 12, and a beater angle adjusting device 40, adjusting an initial angle of the beater 16. The beater angle adjusting device 40 includes the shaft 15, to which the beater 16 is fixed, the cam 21, fixed to the end portion of the shaft 15, and a bolt 21*a*, provided on the cam 21. The cam 21 is fixed to the end portion of the shaft 15 by the bolt 21*a*. When the bolt 21*a* is loosened, the shaft 15 becomes pivotable with respect to the cam 21. At this point, the cam 21 is held in a vertically downward orientation by the tension coil spring 17. The initial angle of the beater 16 is thus adjusted by pivoting the beater 16, together with the shaft 15, with respect to the cam 21. After adjusting the initial angle of the beater 16, the initial angle of the beater 16 is fixed by fastening the bolt 21*a*.

Figure 2:
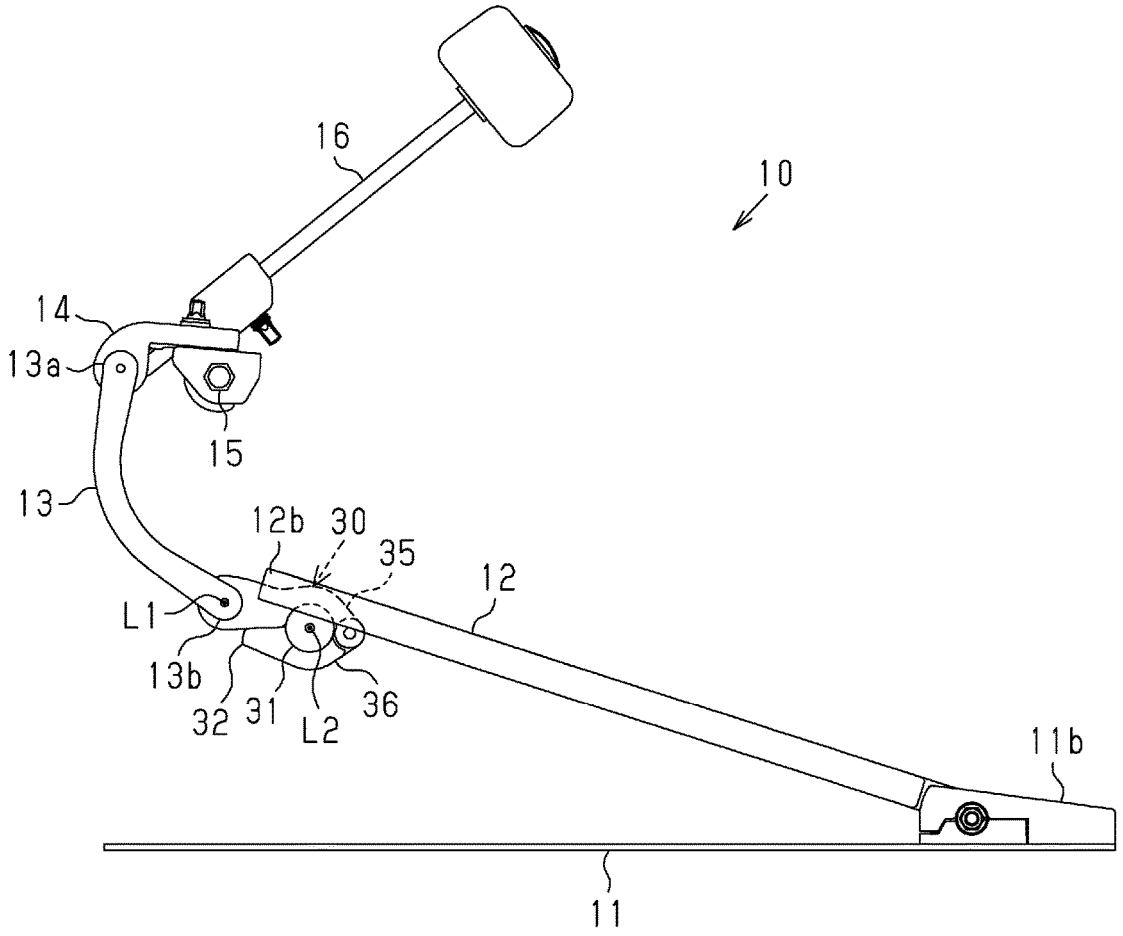
FIG. 2 is a side view of an arrangement in a vicinity of a pedal angle adjusting device of the pedal device.
Figure 3:
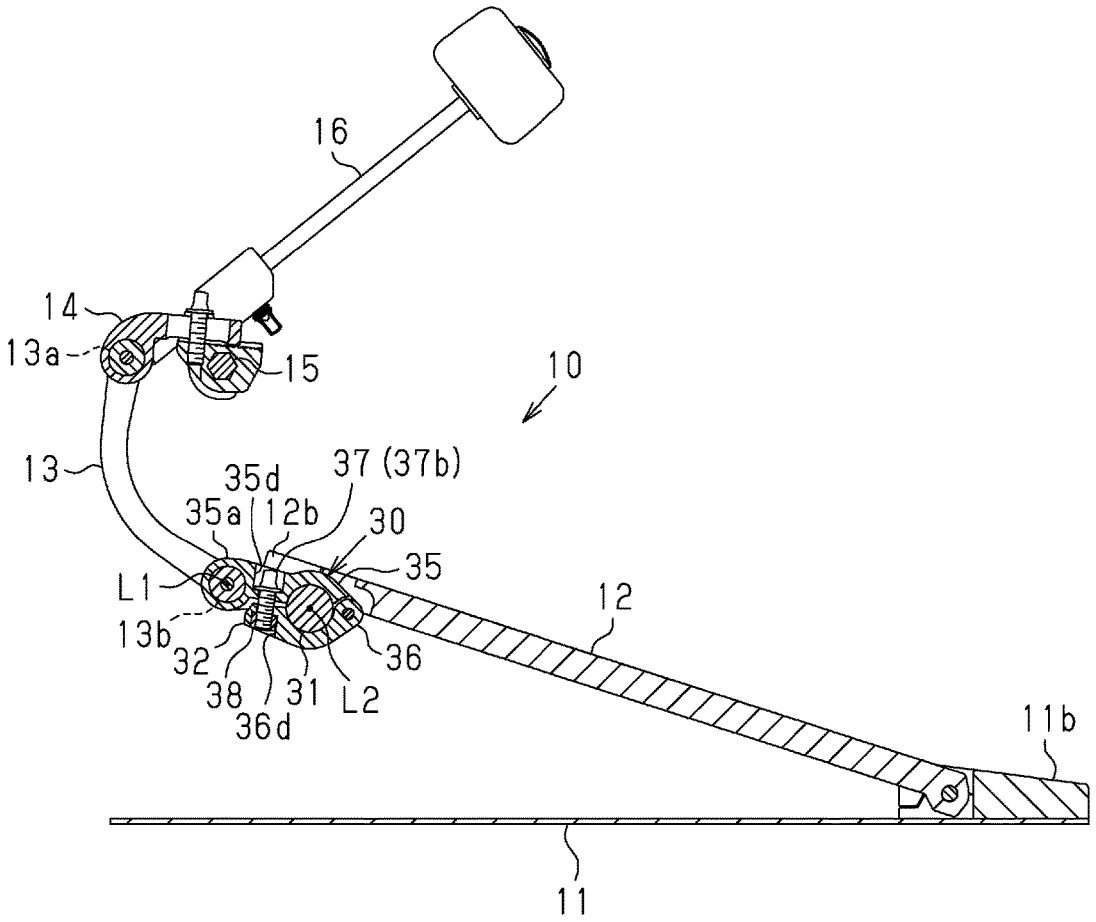
FIG. 3 is a sectional view of the arrangement in the vicinity of the pedal angle adjusting device of the pedal device.

As shown in FIG. 2 and FIG. 3, the pedal angle adjusting device 30 couples the coupling arms 13 and the free end 12*b* of the pedal 12 and is arranged to enable a height of an axis L2 with respect to an axis L1 to be adjusted with respect to the coupling arms 13. Specifically, the pedal angle adjusting device 30 is coupled to the coupling arms 13 such as to be pivotable about the axis L1. Also, the pedal angle adjusting device 30 is coupled to the free end 12*b* of the pedal 12 such as to be pivotable about the axis L2 and is arranged to be fixable with respect to the free end 12*b* of the pedal 12. The pedal angle adjusting device 30 is arranged by assembling a shaft member 31, provided at the free end 12*b* of the pedal 12, and a fixed member 32, provided at the lower ends 13*b* of the coupling arms 13.

Figure 4:
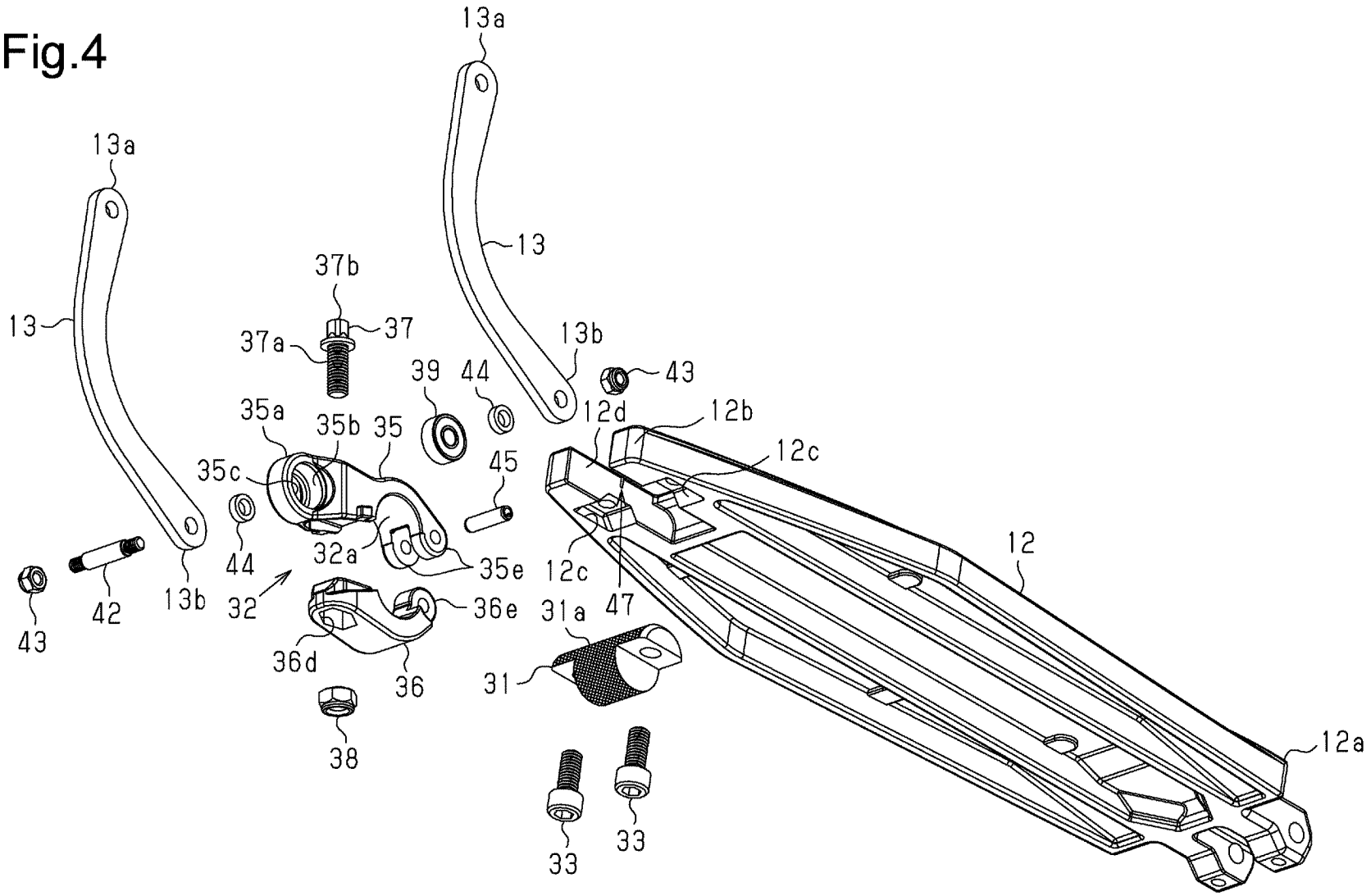
FIG. 4 is an exploded perspective view of the arrangement in the vicinity of the pedal angle adjusting device of the pedal device.

As shown in FIG. 3 and FIG. 4, a pair of fixing recesses 12*c*, to which the shaft member 31 is fixed, and a single housing recess 12*d*, in which the fixed member 32 is housed, are formed at a rear side of the pedal 12. The shaft member 31 is fixed to a lower surface of the pedal 12 in a state where both end portions of the shaft member 31 are disposed in the pair of fixing recesses 12*c*. The shaft member 31 is fixed to the lower surface of the pedal 12 from below by a pair of bolts 33, inserted through both end portions of the shaft member 31. The shaft member 31 has, at a central portion excluding both end portions, an outer circumferential surface 31*a* as a first contact surface contacting the fixed member 32. Diamond knurling is applied to the outer circumferential surface 31*a* of the shaft member 31.

The fixed member 32 includes a first clamp member 35, gripping the shaft member 31 from above, a second clamp member 36, gripping the shaft member 31 from below, and a bolt 37 and a nut 38 as fastening members. The first clamp member 35 has a coupling portion 35*a* coupled to the coupling arms 13. A recess 35*b* of circular shape, in which a bearing 39 is disposed, and an insertion hole 35*c*, through which a support pin 42 is inserted, are formed in the coupling portion 35*a*.

The first clamp member 35 is pivotably coupled to the lower ends 13*b* of both coupling arms 13 by the support pin 42, a nut 43, a washer 44, etc. The first clamp member 35 has an upper vertical hole 35*d* in a vicinity of the coupling portion 35*a*. A base end 35*e* of the first clamp member 35 is formed to a bifurcated shape. The second clamp member 36 has a lower vertical hole 36*d* at a position corresponding to the upper vertical hole 35*d* of the first clamp member 35. A base end 36*e* of the second clamp member 36 is disposed at an inner side of the base end 35*e* of the first clamp member 35.

The first and second clamp members 35 and 36 are arranged to be capable of gripping the shaft member 31 by the base ends 35*e* and 36*e* thereof being coupled by a support pin 45. Also, the first and second clamp members 35 and 36 are fixed to the outer circumferential surface 31*a* of the shaft member 31 by the bolt 37, inserted through the upper vertical hole 35*d* and the lower vertical hole 36*d*, being fastened by the nut 38. When the bolt 37 is loosened, the first and second clamp members 35 and 36 become pivotable about the axis L2 with respect to the shaft member 31, enabling adjustment of the inclination angle of the pedal 12.

The positions of the upper vertical hole 35*d* and the lower vertical hole 36*d* are set to intermediate positions between the axis L1 and the axis L2 in a state where the bolt 37 is inserted through both vertical holes 35*d* and 36*d*. The axis L1 is a center of pivoting of the pedal angle adjusting device 30 with respect to the coupling arms 13. The axis L2 is a center of pivoting of the pedal angle adjusting device 30 with respect to the free end 12*b* of the pedal 12.

As shown in FIG. 1 and FIG. 4, the bolt 37 has a thread portion 37*a*, inserted through the upper vertical hole 35*d* and the lower vertical hole 36*d* of the first and second clamp members 35 and 36, and a head portion 37*b*, as an operating portion that is operated in adjusting the inclination angle of the pedal 12. The head portion 37*b* of the bolt 37 is disposed to face upward inside the upper vertical hole 35*d* of the first clamp member 35. A scale 46 is provided on an upper surface of the first clamp member 35. In a vicinity of the free end 12*b* of the pedal 12, a mark 47 is formed at a position corresponding to the scale 46. A tool 49, used in adjusting the inclination angle of the pedal 12, is included at an outer side of the support column 11*a* at the left side.

Figure 5A:
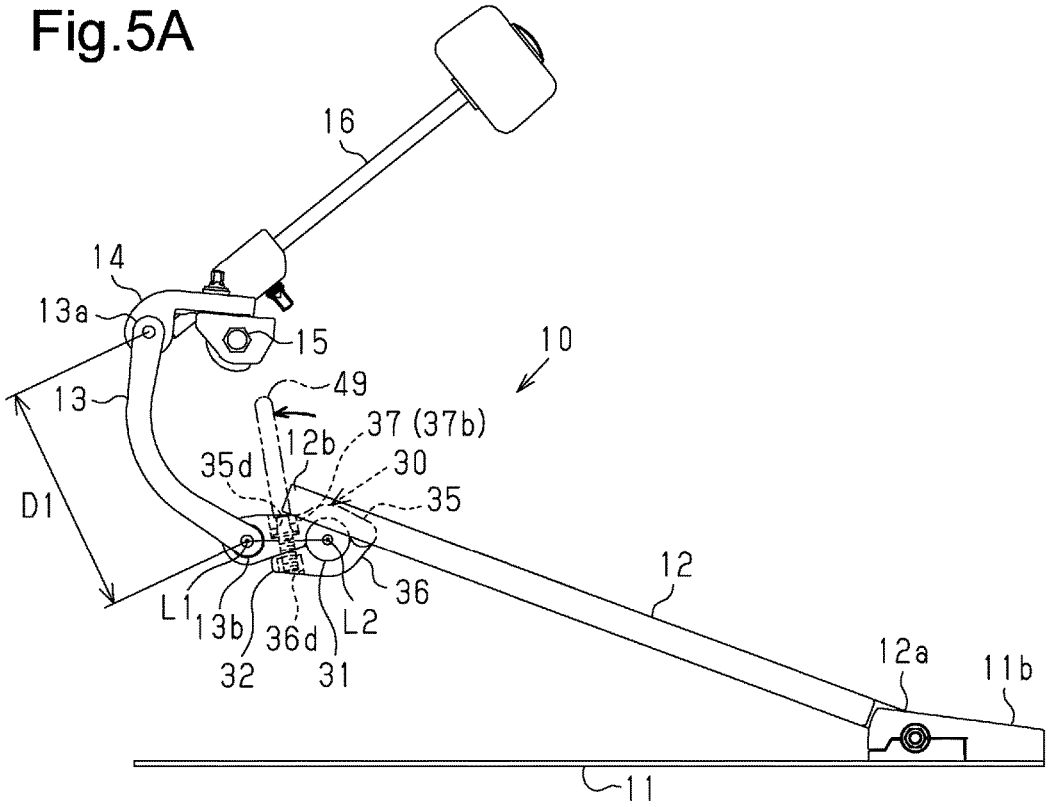
FIG. 5A is a side view of the pedal device before adjustment of an inclination angle of a pedal.
Figure 5B:
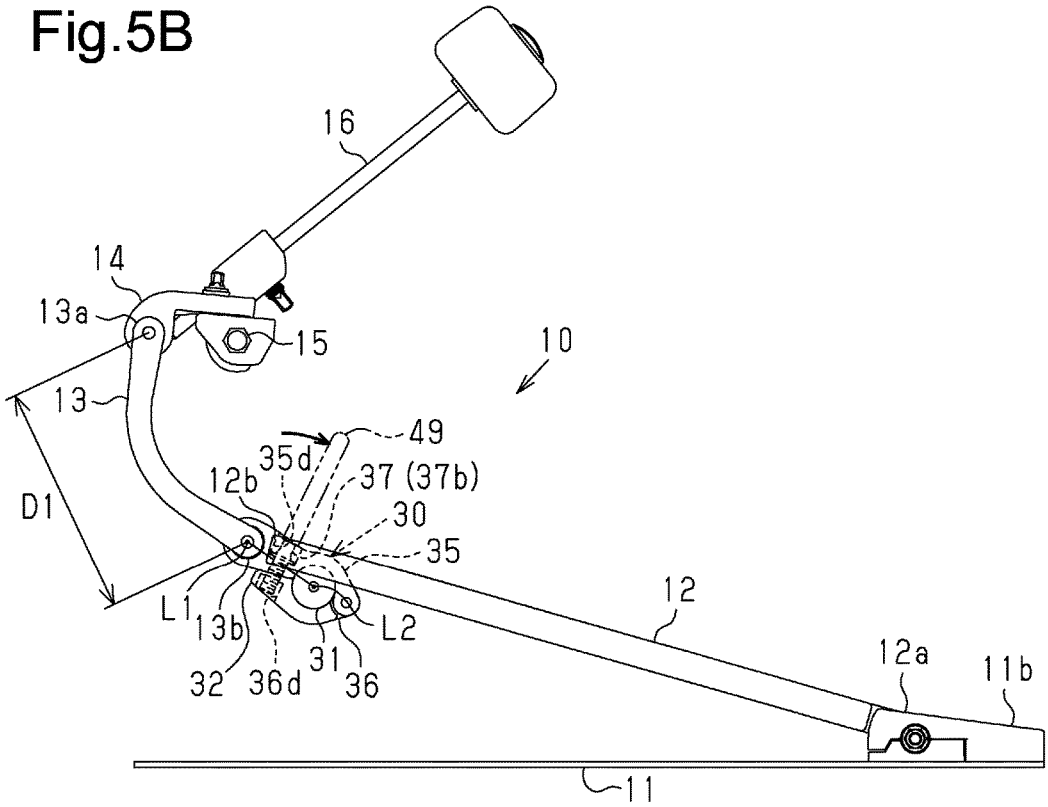
FIG. 5B is a side view of the pedal device after adjustment of the inclination angle of the pedal.

Actions of the pedal device 10 described above shall now be described with reference to FIG. 1, FIG. 5A, and FIG. 5B. Here, a series of operations performed when adjusting the inclination angle of the pedal 12 after adjusting the initial angle of the beater 16 shall be described.

First, the initial angle of the beater 16 is adjusted. As shown in FIG. 1, first, the bolt 21*a* of the cam 21 is loosened to release the fixing of the shaft 15 to the cam 21. Next, the shaft 15 is pivoted with respect to the cam 21 until the beater 16 is set at a desired angle. The bolt 21*a* is then fastened to fix the shaft 15 to the cam 21 and fix the beater 16 at the adjusted angle.

Subsequently, the inclination angle of the pedal 12 is adjusted. First, as shown in FIG. 5A and FIG. 5B, a tip of the tool 49 is fitted from above onto the head portion 37*b* of the bolt 37 that is visible at the front from a user. The tool 49 is then turned to loosen the bolt 37 and thereby release the fixing of the fixed member 32 to the shaft member 31. The fixed member 32 is thereby made pivotable about the axis L2 with respect to the shaft member 31. At this point, the tension coil spring 17 shown in FIG. 1 holds the cam 21 in the vertically downward orientation. Therefore, even if the bolt 37 of the pedal angle adjusting device 30 is loosened, the cam 21 is held in the same vertically downward orientation as that before the loosening of the bolt 37. The beater 16 is thus also maintained at the adjusted angle. Also, the wheel 14 and the shaft 15 are also respectively maintained at angle positions corresponding to the angle of the beater 16. Height positions of the upper ends 13*a* of the coupling arms 13 coupled to the wheel 14 are thus also maintained.

On the other hand, when the bolt 37 is loosened, the free end 12*b* of the pedal 12 moves downward due to the weight of the pedal 12 itself. That is, the pedal 12 pivots counterclockwise in FIG. 5A about the base end 12*a* of the pedal 12, coupled to the heel portion 11*b*, as a center. At this point, a first coupling location of the wheel 14 and the coupling arm 13, a second coupling location of the coupling arm 13 and the pedal angle adjusting device 30, and a third coupling location of the pedal angle adjusting device 30 and the pedal 12 are all in pivotable states. Therefore, when the bolt 37 is loosened, the free end 12*b* of the pedal 12 moves downward while changing coupling angles at the first to third coupling locations until the first to third coupling locations are disposed on the same straight line. That is, the pedal 12 is put in an orientation of being inclined at an angle at which the first to third coupling locations are disposed on the same straight line and is held in the inclined orientation.

Next, the inclination angle of the pedal 12 is adjusted using the tool 49 fitted onto the head portion 37*b* of the bolt 37. Specifically, as indicated by arrows in FIG. 5A and FIG. 5B, the tool 49 itself, which is fitted onto the head portion 37*b* of the bolt 37, is tilted forward or rearward to make the fixed member 32 pivot about the axis L2 with respect to the shaft member 31. At this point, the pedal 12 is held in the orientation, in which the first to third coupling locations are disposed on the same straight line, by the elastic force of the tension coil spring 17. From this state, the user pivots the fixed member 32 about the axis L2 with respect to the shaft member 31 by tilting forward or rearward the tool 49 itself and without holding the pedal 12 with a hand. The user thus adjusts the inclination angle of the pedal 12 by operating the pedal angle adjusting device 30 using the tool 49 to adjust the height of the axis L2 with respect to the axis L1.

After the pedal 12 is adjusted to a desired angle, the tool 49 is turned to fasten the bolt 37 and thereby fix the fixed member 32 to the shaft member 31. Even at this point, the pedal 12 is held in the orientation of being inclined at the adjusted angle by the elastic force of the tension coil spring 17. The user thus operates the pedal angle adjusting device 30 using the tool 49 to fix the height of the axis L2 with respect to the axis L1 and fix the pedal 12 at the adjusted angle without holding the pedal 12 with a hand.

Through the above series of operations, just the inclination angle of the pedal 12 is adjusted without influencing the adjusted angle of the beater 16. Also, as shown in FIG. 5A and FIG. 5B, a link length D1, which is a length of a portion that pivots about an upper end of a coupling arm 13 as a center when the pedal 12 is stepped on, does not change before and after adjusting the inclination angle of the pedal 12 and is fixed. An operation feel of the pedal 12 is thus not changed by adjusting the inclination angle of the pedal 12.

Thus, according to the present embodiment, the following effects can be obtained.

(1) The pedal angle adjusting device 30 is coupled to the coupling arms 13 such as to be pivotable about the axis L1. Also, the pedal angle adjusting device 30 is coupled to the free end 12*b* of the pedal 12 such as to be pivotable about the axis L2 and is arranged to be fixable with respect to the free end 12*b* of the pedal 12. According to this arrangement, by pivoting the pedal angle adjusting device 30 about the axis L2 with respect to the free end 12*b* of the pedal 12, the inclination angle of the pedal 12 can be adjusted while adjusting the height of the axis L2 with respect to the axis L1. Also, after adjusting the inclination angle of the pedal 12, the inclination angle of the pedal 12 can be fixed by fixing the pedal angle adjusting device 30 to the free end 12*b* of the pedal 12. The user can thus adjust the inclination angle of the pedal 12 by just changing the coupling angle of the pedal angle adjusting device 30 with respect to the pedal 12. It is thus possible to easily adjust just the inclination angle of the pedal 12.

(2) The bolt 37 has the head portion 37*b* as the operating portion that is operated in adjusting the inclination angle of the pedal 12. The head portion 37*b* of the bolt 37 is disposed to face upward inside the upper vertical hole 35*d* of the first clamp member 35. According to this arrangement, the head portion 37*b* of the bolt 37 is disposed at a position that is easily visible and easily operable for the user in adjusting the inclination angle of the pedal 12. The work of adjusting the inclination angle of the pedal 12 is thus made easy.

(3) The tension coil spring 17 is coupled, via the coupling ring 19, the cam 21, the shaft 15, the wheel 14, the coupling arms 13, and the pedal angle adjusting device 30, to the pedal 12. According to this arrangement, the tension coil spring 17 is capable of holding the free end 12*b* of the pedal 12 at a predetermined height via the pedal angle adjusting device 30 and the coupling arms 13 in the state where the pedal angle adjusting device 30 is pivotably coupled respectively to the coupling arms 13 and the pedal 12.

In this case, when the bolt 37 of the pedal angle adjusting device 30 is loosened, the free end 12*b* of the pedal 12 moves downward, due to the weight of the pedal 12 itself, until the first to third coupling locations are disposed on the same straight line. That is, after being put in the orientation of being inclined at the angle at which the first to third coupling locations are disposed on the same straight line, the pedal 12 is held in the orientation of being inclined at that angle by the elastic force of the tension coil spring 17. Therefore, even after adjustment of the inclination angle of the pedal 12, the pedal 12 is held in the orientation of being inclined at the adjusted angle.

Also, the user can perform the operation of loosening and fastening the bolt 37 using the tool 49 and the operation of tilting the tool 49 itself forward or rearward to adjust the inclination angle of the pedal 12 in a continuous manner. The inclination angle of the pedal 12 can thus be adjusted more easily than by the conventional method of adjusting the inclination angle of the pedal 12 while holding the pedal 12 with a hand.

(4) The pedal angle adjusting device 30 is arranged from the shaft member 31, provided at the free end 12*b* of the pedal 12, and the fixed member 32, provided at the lower ends 13*b* of the coupling arms 13. With the present embodiment, the pedal angle adjusting device 30 is dividedly arranged from the shaft member 31 and the fixed member 32 and these are provided respectively at the coupling arms 13 and the free end 12*b* of the pedal 12. Thereby, the height of the axis L2 with respect to the axis L1 can be adjusted while pivoting the fixed member 32 about the axis L2 with respect to the shaft member 31. That is, the user can adjust the inclination angle of the pedal 12 by just moving the fixed member 32 such as to be flexed with respect to the shaft member 31.

Also, according to this arrangement, by respectively providing the shaft member 31 at the free end 12*b* of the pedal 12 and the fixed member 32 at the lower ends 13*b* of the coupling arms 13, the link length D1 is not changed before and after adjusting the inclination angle of the pedal 12. That is, when the inclination angle of the pedal 12 is adjusted, the link length D1 is fixed regardless of the flexural angle of the shaft member 31 and the fixed member 32. Therefore, even when the inclination angle of the pedal 12 is adjusted, the operation feel when the pedal 12 is stepped on is not changed. Therefore, just the inclination angle of the pedal 12 can be adjusted without changing the operation feel of the pedal.

(5) The fixed member 32 includes the first clamp member 35, gripping the shaft member 31 from above, the second clamp member 36, gripping the shaft member 31 from below, and the bolt 37 and the nut 38 as the fastening members. According to this arrangement, the fixed member 32 has a clamp structure that grips the shaft member 31 from both above and below. Thus, by fastening the bolt 37 to the nut 38, the first and second clamp members 35 and 36 can thus be fixed at a side opposite to the base ends 35*e* and 36*e* in the state where the first and second clamp members 35 and 36 grip the shaft member 31. A fixing force of the fixed member 32 with respect to the shaft member 31 can thus be increased. The flexural angle of the shaft member 31 and the fixed member 32 is thus maintained readily and it is easy to fix the inclination angle of the pedal 12 at the desired angle. Also, the arrangement in the vicinity of the free end 12*b* of the pedal 12 can be simplified unlike in the conventional arrangement where an inclination angle of a pedal is adjusted by vertically sliding the pedal with respect to a link member or a chain.

(6) Diamond knurling is applied to the outer circumferential surface 31*a* of the shaft member 31. According to this arrangement, the fixing force of the fixed member 32 with respect to the shaft member 31 can be increased further because the knurling is applied to a contact surface of the shaft member 31 and the fixed member 32.

(7) The shaft member 31 is fixed to the lower surface of the pedal 12. According to this arrangement, there is no obstacle on a stepping surface of the pedal 12 and the stepping surface can be made flat in shape. The shaft member 31 thus does not obstruct the stepping operation of the pedal 12.

Figure 6:
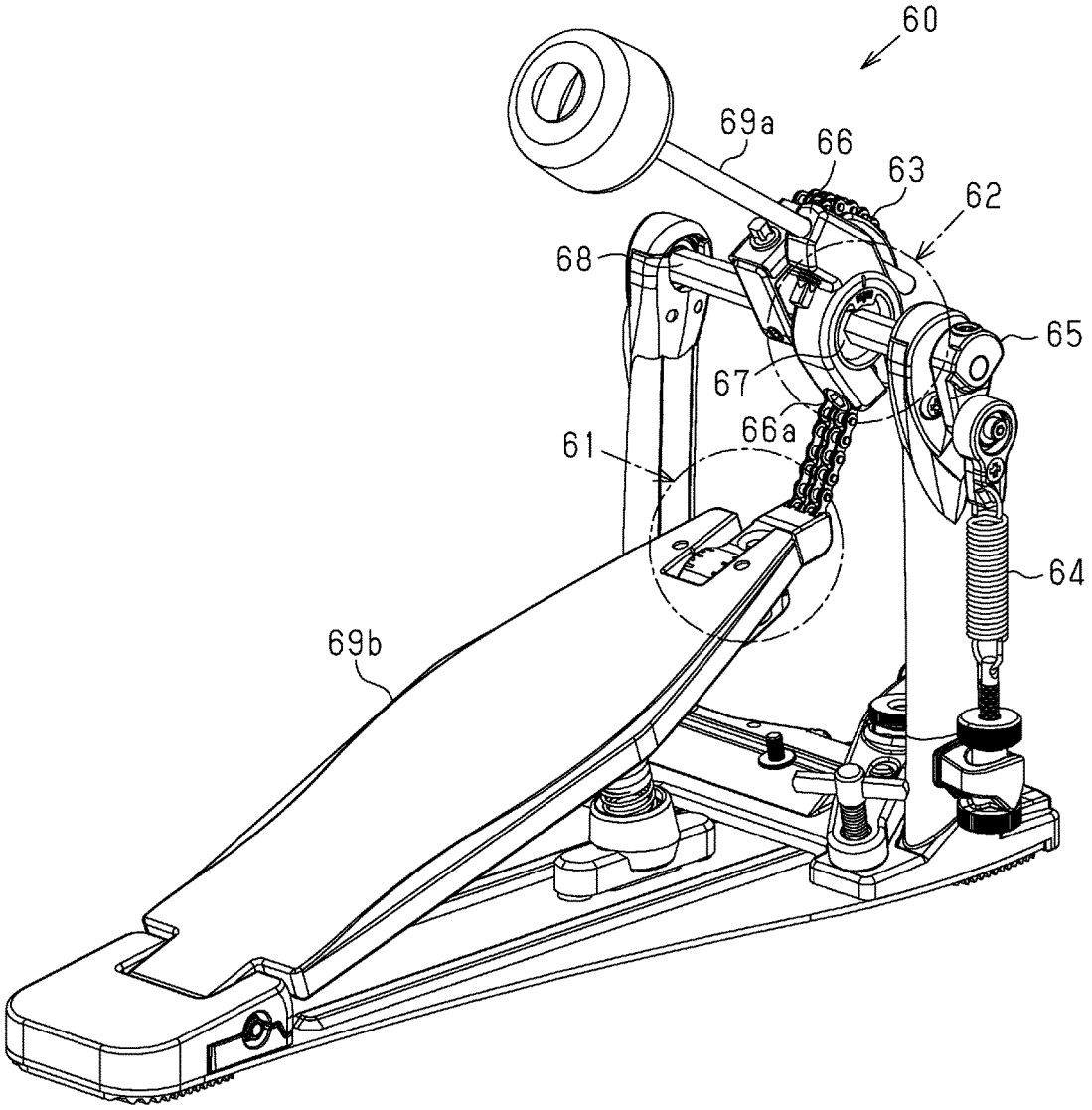
FIG. 6 is a perspective view of a pedal device of another example.

In addition, the present embodiment may be modified as follows:

For example, a pedal device 60, shown in FIG. 6, may be adopted in place of the pedal device 10. As shown in FIG. 6, the pedal device 60 has a pedal angle adjusting device 61 and a beater angle adjusting device 62. With the pedal device 60, a sprocket wheel 63 is fixed, together with a rocker cam 65, coupled to a tension coil spring 64, a circular columnar body 67, to which a beater fixing member 66, is fixed, etc., to a shaft 68. Also, a beater 69*a* is pivotably mounted to an outer circumferential surface of the circular columnar body 67 by a bolt 66*a* provided on the beater fixing member 66.

To adjust an initial angle of the beater 69*a*, first, the bolt 66*a* of the beater fixing member 66 is loosened. Next, the beater fixing member 66 is slid in a circumferential direction along the outer circumferential surface of the circular columnar body 67 until the beater 69*a* is set at a desired angle. The bolt 66*a* is then fastened to fix the beater fixing member 66 to the circular columnar body 67 and fix the initial angle of the beater 69*a*. Here, the pedal angle adjusting device 30 of the present embodiment is adopted in the pedal angle adjusting device 61. Even with this arrangement, an inclination angle of a pedal 69*b* and the initial angle of the beater 69*a* can be adjusted separately and just the inclination angle of the pedal 69*b* can be adjusted easily.

Figure 7:
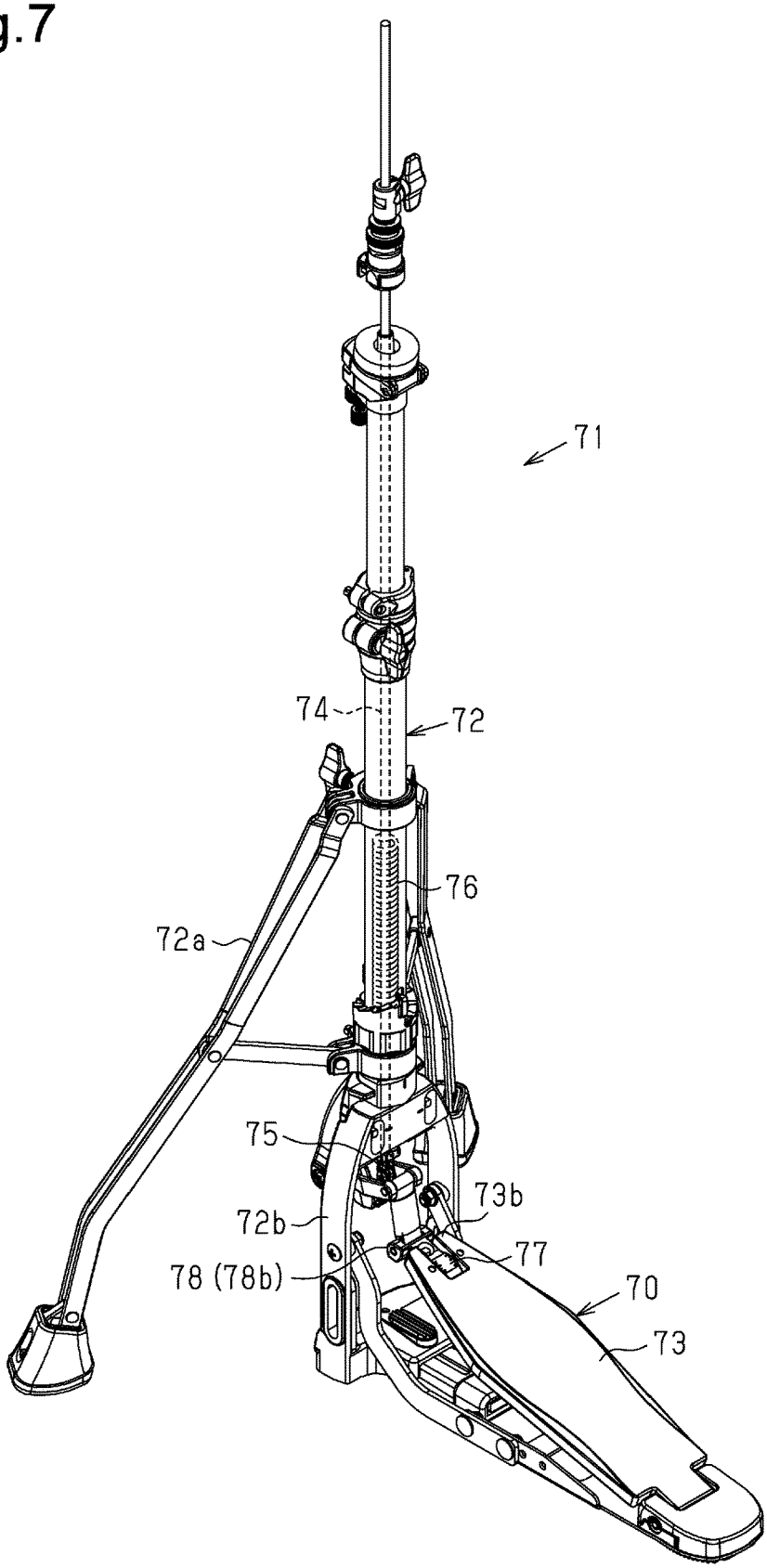
FIG. 7 is a perspective view of a high hat stand that includes a pedal device.

In the present embodiment, the pedal device for musical instrument according to the present invention is applied to the bass drum BD shown in FIG. 1. The pedal device for musical instrument according to the present invention may instead be applied to a high hat stand 71 shown in FIG. 7. As shown in FIG. 7, the high hat stand 71 includes a stand main body 72, having a bipod 72*a* and a gate frame 72*b*, and a pedal device 70, mounted to the gate frame 72*b*. Also, the high hat stand 71 includes a rod 74, as an actuating member moved vertically by a stepping operation of a pedal 73, a chain 75, as a coupling member transmitting an operating force of the pedal 73 to the rod 74, and a compression coil spring 76, which is compressed when the pedal 73 is stepped on.

Further, the high hat stand 71 includes a pedal angle adjusting device 77 coupling the chain 75 and a free end 73*b* of the pedal 73 and adjusting an inclination angle of the pedal 73. Even with this high hat stand 71, the angle of the pedal 73 can be adjusted by just tilting a tool, fitted into a head portion 78*b* of a bolt 78, forward or rearward. In this case, a height of the rod 74 is not changed and therefore an amount of compression of the compression coil spring 76 by the rod 74 does not change. Just the inclination angle of the pedal 73 can thus be adjusted easily without changing an operation feel of the pedal 73.

Although a direct drive system is adopted in the pedal device 10, a chain drive system, using a chain in place of the coupling arms 13, or a belt drive system, using a belt in place of the coupling arms 13, may be adopted instead.

The pedal angle adjusting device 30 is arranged by assembling the two parts of the shaft member 31 and the fixed member 32. The pedal angle adjusting device 30 may instead be arranged from a single part by forming the shaft member 31 in advance on the coupling arms 13 or the free end 12*b* of the pedal 12.

The head portion 37*b* of the bolt 37 as the operating portion is disposed to face upward inside the upper vertical hole 35*d* of the first clamp member 35. The head portion 37*b* of the bolt 37 may instead be disposed to face downward. In this case, the bolt 37 is inserted from below into both vertical holes 35*d* and 36*d* of the first and second clamp members 35 and 36 and the nut 38 is fastened from above to a tip of the bolt 37.

Figure 8:
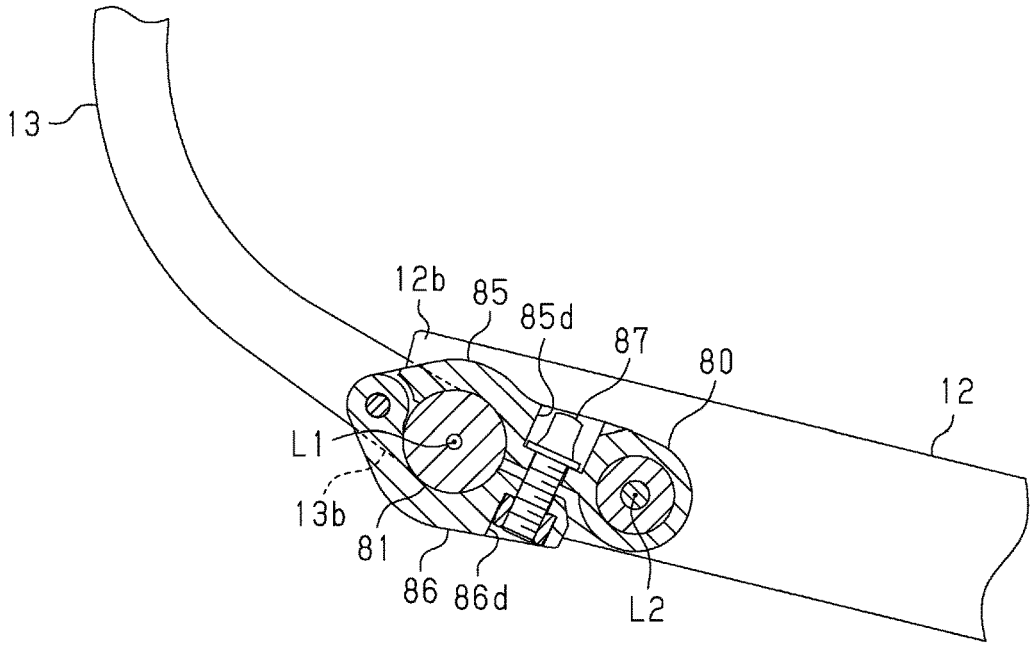
FIG. 8 is a partial sectional view showing a vicinity of a pedal angle adjusting device of another example in enlarged manner.
Figure 9:
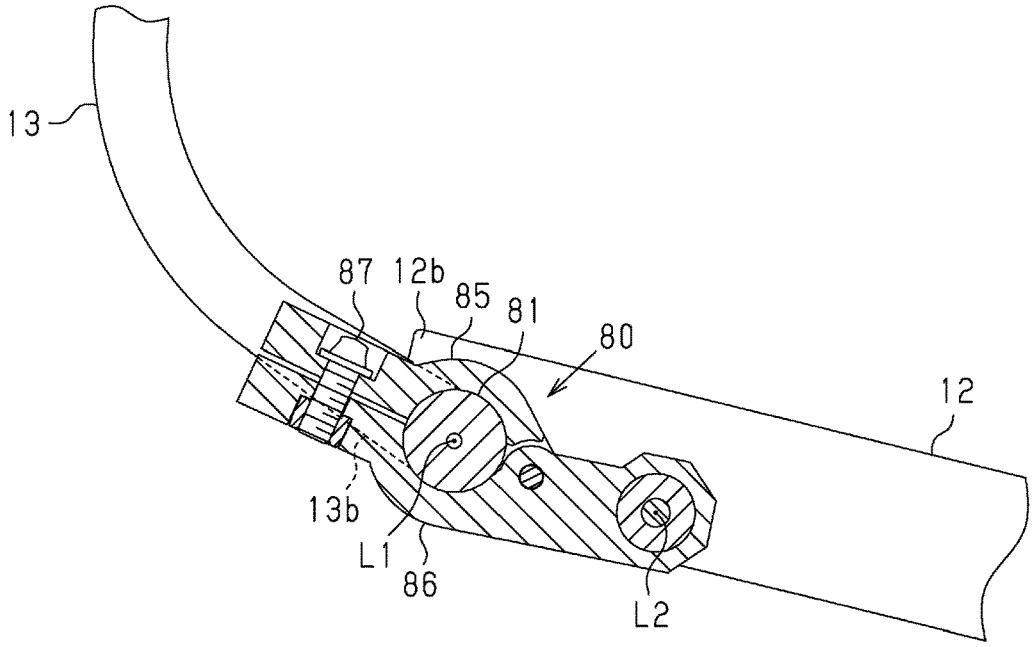
FIG. 9 is a partial sectional view showing a vicinity of a pedal angle adjusting device of another example in enlarged manner.

Although in the present embodiment, the shaft member 31 is provided at the free end 12*b* of the pedal 12 and the fixed member 32 is provided at the lower ends 13*b* of the coupling arms 13, the positional relationship of the shaft member 31 and the fixed member 32 with respect to the pedal 12 and the coupling arms 13 may be inverted. As shown in FIG. 8 and FIG. 9, a fixed member 80 may be provided at the free end 12*b* of the pedal 12 and a shaft member 81 may be provided at the lower ends 13*b* of the coupling arms 13. In this case, the position of a bolt 87 that is inserted through both vertical holes 85*d* and 86*d* of first and second clamp members 85 and 86 that constitute the fixed member 80 may be to the rear of the shaft member 81 as shown in FIG. 8 or may be to the front of the shaft member 81 as shown in FIG. 9.

Figure 10:
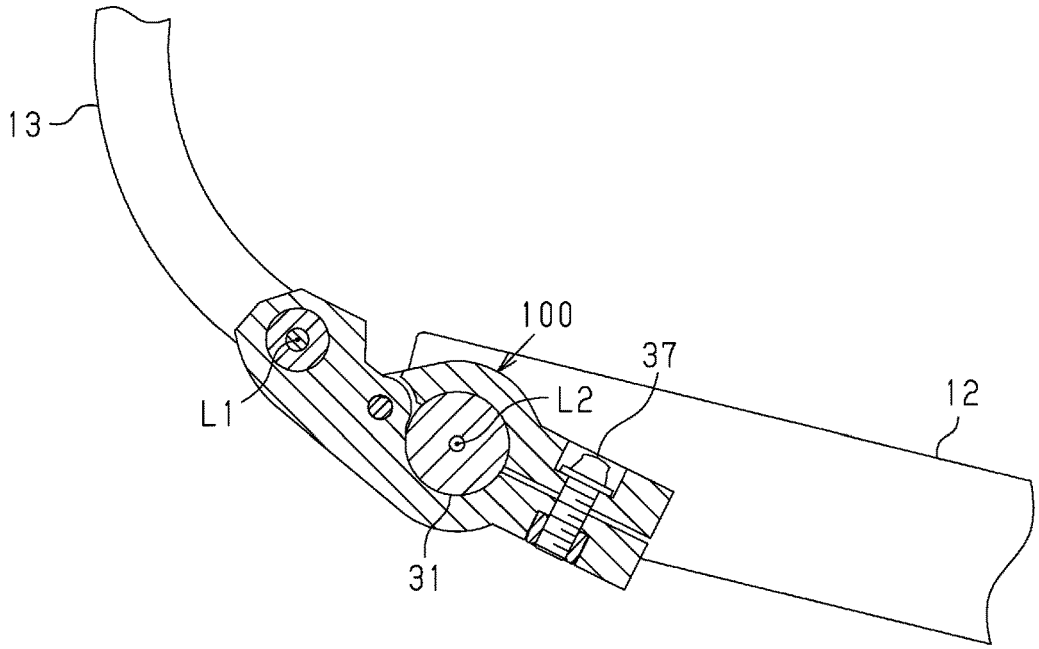
FIG. 10 is a partial sectional view showing a vicinity of a pedal angle adjusting device of another example in enlarged manner.

Although in the present embodiment, the location at which the first and second clamp members 35 and 36 are fastened by the bolt 37 is to the front of the shaft member 31, it may be to the rear of the shaft member 31 as in a pedal angle adjusting device 100 shown in FIG. 10.

Figure 11:
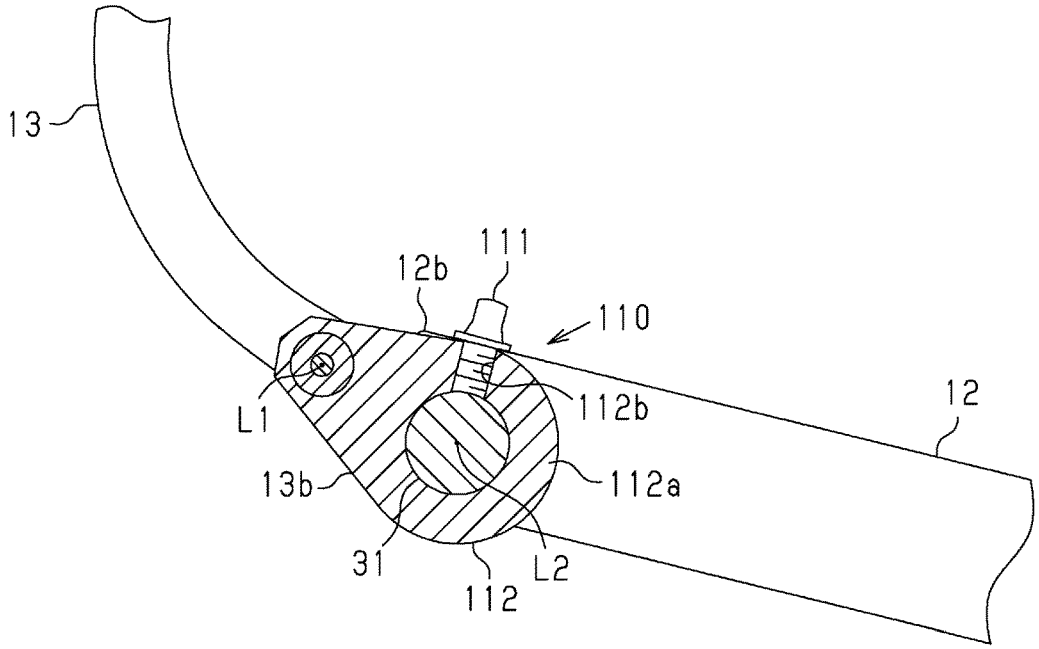
FIG. 11 is a partial sectional view showing a vicinity of a pedal angle adjusting device of another example in enlarged manner.

The fixed member 32 has the clamp structure constituted of the first and second clamp members 35 and 36 that grip the shaft member 31 from both upper and lower directions. Instead of this, a pedal angle adjusting device 110 may be arranged to directly fix a fixed member 112 to the shaft member 31 using a bolt 111 as shown in FIG. 11. With the example shown in FIG. 11, the shaft member 31 is provided at the free end 12*b* of the pedal 12 and the fixed member 112 is provided at the lower ends 13*b* of the coupling arms 13. The fixed member 112 is formed to a cylindrical shape that includes an internal space that slidably supports the shaft member 31 of circular columnar shape. A screw insertion hole 112*b* in which a bolt 111 is threadedly engaged, is formed in a circumferential wall 112*a* of the fixed member 112.

Figure 12:
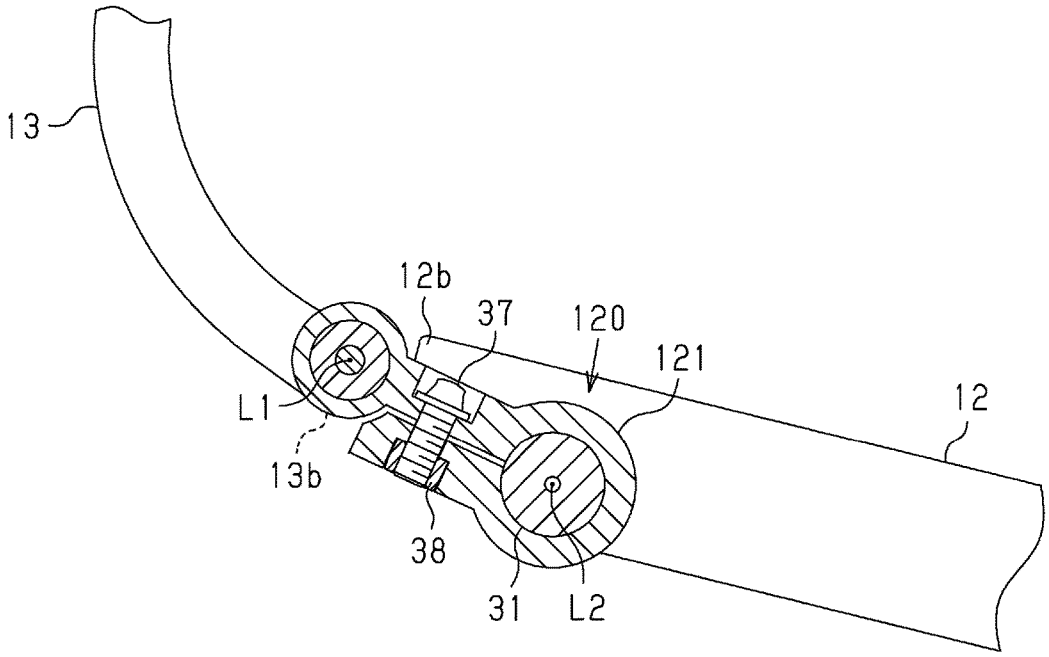
FIG. 12 is a partial sectional view showing a vicinity of a pedal angle adjusting device of another example in enlarged manner.

As shown in FIG. 12, a pedal angle adjusting device 120 may be arranged from a clip member 121 with a U-shaped cross section and the bolt 37 and the nut 38 that fasten a pair of tip portions of the clip member 121.

Diamond knurling is applied to just the outer circumferential surface 31*a* of the shaft member 31 that contacts the fixed member 32. Instead of this, diamond knurling may also be applied to an inner circumferential surface 32*a* as a second contact surface of the fixed member 32 that contacts the shaft member 31 as shown in FIG. 4.

Straight knurling may be applied instead of diamond knurling to the outer circumferential surface 31*a* of the shaft member 31.

The invention claimed is:

1. A pedal device for musical instrument, comprising:

a base, having a front end and a rear end;

a pedal, pulled upward at the front end of the base, pivotably coupled to the rear end of the base, and being pivoted about the rear end of the base as a center by a stepping operation;

an actuating member, actuated by the stepping operation of the pedal;

a coupling member, coupling the actuating member and a free end of the pedal and transmitting an operating force of the pedal to the actuating member; and a pedal angle adjusting device, coupling the coupling member and the free end of the pedal and adjusting an inclination angle of the pedal; and wherein the pedal angle adjusting device is arranged to be pivotable about axes respectively with respect to the coupling member and the free end of the pedal and be fixable with respect to one of either of the coupling member and the free end of the pedal.

2. The pedal device for musical instrument according to claim 1, wherein the pedal angle adjusting device includes an operating portion, operated in adjusting the inclination angle of the pedal, and the operating portion is disposed to face upward.

3. The pedal device for musical instrument according to claim 1, further comprising: a spring for holding the pedal at an initial position before stepping on the pedal; and wherein the spring is coupled to the pedal via the coupling member and the pedal angle adjusting device.

4. The pedal device for musical instrument according to claim 1, wherein the pedal angle adjusting device includes a shaft member, provided at one of the coupling member and the free end of the pedal, and a fixed member, provided at the other of the coupling member and the free end of the pedal, and the fixed member is arranged to be pivotable about the axis with respect to the shaft member and be fixable with respect to the shaft member.

5. The pedal device for musical instrument according to claim 4, wherein the shaft member is provided at the free end of the pedal and the fixed member is provided at a lower end of the coupling member.

6. The pedal device for musical instrument according to claim 4, wherein the fixed member includes a first clamp member, gripping the shaft member from above, a second clamp member, pivotably coupled to a base end of the first clamp member and gripping the shaft member from below, and a fastening member, used to fix the first and second clamp members at a side opposite to base ends thereof.

7. The pedal device for musical instrument according to claim 4, wherein the shaft member has a first contact surface contacting the fixed member, the fixing member has a second contact surface contacting the shaft member, and knurling is applied to at least one of either of the first contact surface and the second contact surface.

8. The pedal device for musical instrument according to claim 4, wherein the shaft member is provided at a lower surface of the pedal.

* * * * *